United States Patent [19]

Leppänen

[11] Patent Number: 4,911,225

[45] Date of Patent: Mar. 27, 1990

[54] MOULD FOR BILLETS

[75] Inventor: Yrjö T. J. Leppänen, Pori, Finland

[73] Assignee: Outokumpu Oy, Helsinki, Finland

[21] Appl. No.: 275,068

[22] Filed: Nov. 21, 1988

Related U.S. Application Data

[63] Continuation-in-part of Ser. No. 76,308, Jul. 22, 1987, abandoned.

[30] Foreign Application Priority Data

Aug. 15, 1986 [FI] Finland ..... 863308

[51] Int. Cl.[4] ..... B22D 11/00

[52] U.S. Cl. ..... 164/459; 164/138; 164/418

[58] Field of Search ..... 164/418, 459, 138, 46

[56] References Cited

FOREIGN PATENT DOCUMENTS 54-4239 1/1979 Japan ..... 164/418

57-31445 2/1982 Japan ..... 164/138

*Primary Examiner*—Kuang Y. Lin

*Attorney, Agent, or Firm*—Dellett, Smith-Hill & Bedell

[57] ABSTRACT

A mould for the continuous casting of billets of steel or other metal with a high melting point is manufactured by electroforming and is reinforced throughout its thickness by a reinforcing material, such as carbon, boric, or glass fibers.

18 Claims, 1 Drawing Sheet

MOULD FOR BILLETS

CROSS-REFERENCE TO RELATED APPLICATION

This is a continuation-in-part of co-pending patent application Ser. No. 07/076,308, filed July 22, 1987, now abandoned.

BACKGROUND OF THE INVENTION

This invention relates to a mould for use in the continuous casting of billets of metals with a high melting point, particularly iron and steel, and to a method of manufacturing such a mould.

Copper is widely used in continuous casting moulds, because of its good thermal conductivity and because it is fairly strong. Frequently, copper is used in a continuous casting mould as a substrate for other metals, which are typically selected for their strength, lubricity, and hardness.

U.S. Pat. No. 4,037,646 discloses a mould having a substrate made of copper, an innermost layer of nickel and/or cobalt which, in addition, contains phosphorus or boron, and a layer of nickel and/or cobalt which binds the innermost layer to the copper substrate. On exposure to heat during the casting process, the innermost layer of the mould described in Pat. No. 4,037,646 increases in hardness, e.g. from about 400 HV to 1000 HV.

German Patent Application No. 3,336,373 describes a mould having an inner layer that is formed by electrolytic precipitation and is composed mainly of nickel. The strength of the inner layer may be increased by incorporating particles of silicon carbide in the nickel.

European Patent Application No. 0,125,509 discloses a mould having a substrate made of copper on which an inner layer of a hard wearing material, such as nickel, is deposited. The thickness of the inner layer is about 35% of the total thickness of the mould (substrate plus inner layer). The inner layer may be fiber-reinforced in the manner described in German Patent Application No. 3,038,289.

In the case of European Patent Application No. 0,125,509, the copper substrate is manufactured by electroforming, i.e., electrolytic precipitation of copper onto a form. Electroforming is conventionally used for manufacture of waveguides and masters for phonograph records.

Japanese Patent Application No. 56-154,262 discloses a mould having the construction shown in FIG. 1. This mould comprises a substrate 2 of copper or copper alloy, a reinforcing layer 3 of nickel or nickel/cobalt alloy containing fibers of SiC, $Al_2O_3$ or $Si_3N_4$ and particles of wear resisting material, such as WC, Si, alumina, TiN or Cr oxide. The mould also has an innermost layer 4 of chromium.

Chromium is generally used in a continuous casting mould because of its strength and lubricity. However, when chromium, which is brittle, is deposited over copper, which is soft, it is liable to fracture. The reinforcing layer of nickel or nickel/cobalt alloy is employed in Japanese Patent Application No. 56-154,262 because it is harder than copper and reduces the likelihood that the layer of chromium will break.

Each of the methods described above for manufacturing a mould has the disadvantage that the material of the substrate, i.e., copper, is not very strong, and the strength of the mould is not increased substantially by plating. Consequently, the mould is easily deformed in use and tends to bulge, which may take place irrespective of the cooling of the substrate. A plating containing reinforcing material, as described with reference to Japanese Patent Application No. 56-154,262, for example, does not increase the strength of the mould substantially.

SUMMARY OF THE INVENTION

A preferred embodiment of the present invention in a first aspect is a mould for continuous casting of billets of metal, the mould comprising an inner layer of a metal selected from the group consisting of nickel and nickel-cobalt alloys and having particles of molybdenum disulfide or graphite dispersed therein, and an outer layer, which is bonded to the inner layer and comprises a reinforcing material in a matrix of metal.

A preferred embodiment of the present invention in a second aspect is a method of fabricating a mould for continuous casting of billets of metal, comprising making a form for the mould, electrolytically depositing a metal on the form and co-precipitating a reinforcing material with the electrolytically-deposited metal, whereby the electrolytically-deposited metal and the reinforcing material form the mould, and removing the mould from the form.

BRIEF DESCRIPTION OF THE DRAWINGS

For a better understanding of the invention and to show how the same may be carried into effect, reference will now be made by way of example, to the accompanying drawings in which.

DETAILED DESCRIPTION

Figure 1:
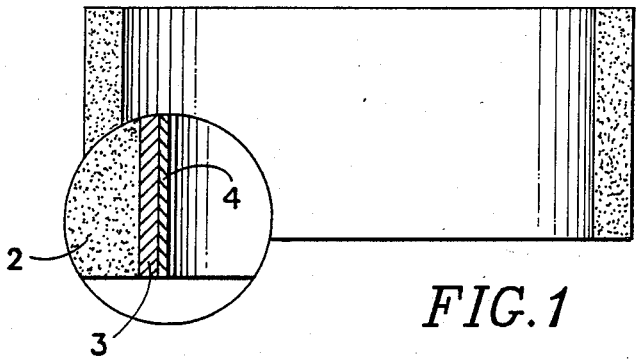
FIG. 1 is a sectional view of a mould of conventional form.
Figure 2:
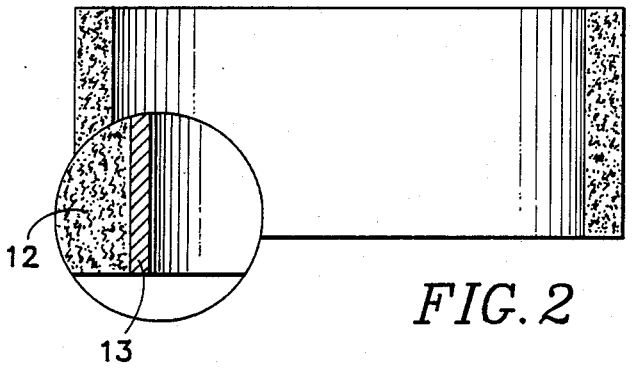
FIG. 2 is a sectional view of a mould embodying the present invention.

The mould illustrated in FIG. 2 comprises an outer layer 12 of metal containing a substantially uniform concentration of a reinforcing agent, such as carbon, boric, or glass fibers, distributed throughout its volume, and an inner layer 13 of nickel or nickel/cobalt alloy containing $MoS_2$ or graphite particles. The mould is manufactured by electroforming. A mould form is made by casting synthetic plastic material into a previously-made mould. The form is removed from the mould, and its surface is made electrically conductive, e.g. by electroless precipitation of metal. The inner layer of nickel or nickel/cobalt alloy is then electrolytically deposited on the mould form, and $MoS_2$ or graphite particles are co-precipitated with the nickel or nickel/cobalt alloy. The thickness of this inner layer is typically in the range from about 1 mm to about 3 mm. Copper is electrolytically deposited over the nickel or nickel/cobalt alloy, and reinforcing fibers are coprecipitated with the copper. The quantity of reinforcing material is about 1–10% by volume of the quantity of copper. This is sufficiently small that the thermal conductivity of the mould is not substantially reduced compared to a mould that does not contain reinforcing material. When a sufficient thickness of copper has been deposited, typically such that the thickness of the mould is in the range from about 6 mm to about 12 mm, the mould is removed from the form.

The layer of copper that is deposited is quite thick, and therefore its outer surface may be rather rough.

When the mould is in use, cooling water contacts its outer surface, and if the outer surface of the mould is rough, impurities in the cooling water tend to stick to the mould. Therefore, when the mould has been removed from the form its outer surface is abraded in order to reduce its roughness. Also, the ends of the mould are machined in order to enable the mould to fit in a continuous casting apparatus, and fastening grooves are machined in the mould for securing the mould in the continuous casting apparatus. Depending on the type of metal that is to be cast using the mould, the inner surface of the mould may be chromium plated.

A mould manufactured by the method described with reference to FIG. 2 has a breaking strength of 600–1000 $N/mm^2$ and a hardness of about 200 HV, whereas generally the breaking strength of a conventional mould for continuous casting is roughly 250–350 $N/mm^2$ and its hardness about 90 HV.

It will be appreciated that the invention is not restricted to the particular embodiment that has been described, and that variations may be made therein without departing from the scope of the invention as defined in the appended claims and equivalents thereof. For example, in some cases it may not be necessary for the reinforcement to be uniform over the axial length of the mould, reinforcement being necessary only in the area where the thermal stress is greatest, i.e., at the level of the boundary between the molten and solid metal, but even in this case the reinforcing material is present over the entire thickness of the substrate instead of only in a thin reinforcing layer at the inner surface of the mould. The layer of nickel or nickel/cobalt alloy is not essential to the invention. If the layer of nickel or nickel/cobalt alloy is omitted, the layer of copper is deposited directly onto the conductive surface of the mould form. The invention is not limited to the metal that is coprecipitated with the reinforcing material being copper, and other metals, such as nickel, alloys of copper and alloys of nickel may be used instead.

I claim:

1. A method of fabricating a mould for continuous casting of billets of metal, comprising making a form for the mould, electrolytically depositing a metal on the form and co-precipitating a reinforcing material with the electrolytically-deposited metal, whereby the electrolytically-deposited metal and the reinforcing material form the mould, and removing the mould from the form.

2. A method according to claim 1, wherein the co-precipitated reinforcing material is a fibrous material.

3. A method according to claim 2, wherein the fibrous material is a material selected from the group consisting of carbon fiber, boric fiber and glass fiber.

4. A method according to claim 1, wherein the quantity of reinforcing material in the mould is 1–10% by volume.

5. A method according to claim 1, wherein the electrolytically-deposited metal is selected from the group consisting of copper, alloys of copper, nickel, and alloys of nickel.

6. A method according to claim 1, wherein the mould has a central axis and the reinforcing material is co-precipitated with the electrolytically deposited metal only at selected positions along the axis of the mould.

7. A method of fabricating a mould for continuous casting of billets of metal, comprising making a form for the mould, depositing an inner layer on the form, the inner layer comprising a metal selected from the group consisting of nickel and nickel-cobalt alloys and having particles selected from the group consisting of molybdenum sulfide and graphite dispersed therein, subsequently electrolytically depositing a metal on the inner layer and co-precipitating a reinforcing material with the electrolytically deposited metal, so as to form an outer layer bonded to the inner layer, whereby the inner and outer layers form the mould, and removing the mould from the form.

8. A method according to claim 7, wherein the co-precipitated reinforcing material is a fibrous material.

9. A method according to claim 8, wherein the fibrous material is a material selected from the group consisting of carbon fiber, boric fiber and glass fiber.

10. A method according to claim 7, wherein the quantity of reinforcing material in the mould is 1–10% by volume.

11. A method according to claim 7, wherein the electrolytically-deposited metal is selected from the group consisting of copper, alloys of copper, nickel, and alloys of nickel.

12. A method according to claim 7, wherein the mould has a central axis and the reinforcing material is co-precipitated with the electrolytically deposited metal only at selected positions along the axis of the mould.

13. A mould for continuous casting of billets of metal, the mould having been fabricated by making a form for the mould, eletrolytically depositing a metal on the form and co-precipitating a reinforcing material with the electrolytically-deposited metal, whereby the electrolytically-deposited metal and reinforcing material form the mould, and removing the mould from the form.

14. A mould for continuous casting of billets of metal, the mould having been fabricated by making a form for the mould, depositing an inner layer on the form, the inner layer comprising a metal selected from the group consisting of nickel and nickel-cobalt alloys and having particles selected from the group consisting of molybdenum disulfide and graphite dispersed therein, subsequently electrolytically depositing a metal on the inner layer, and co-precipitating a reinforcing material with the electrolytically-deposited metal so as to form an outer layer bonded to the inner layer, whereby the inner and outer layers form the mould, and removing the mould from the form.

15. A mould for continuous casting of billets of metal, the mould comprising an inner layer of a metal selected from the group consisting of nickel and nickel-cobalt alloys and having particles selected from the group consisting of molybdenum disulfide and graphite dispersed therein, and an outer layer, which is bonded to the inner layer and comprises a fibrous reinforcing material in a matrix of metal.

16. A mould according to claim 15, wherein the fibrous material is a material selected from the group consisting of carbon fiber, boric fiber, and glass fiber.

17. A mould according to claim 15, wherein the quantity of reinforcing material in the mould is 1–10% by volume.

18. A mould according to claim 15, wherein the reinforcing material is substantially uniformly distributed throughout the thickness of the outer layer.

* * * * *